US011319786B2

(12) United States Patent
Brown et al.

(10) Patent No.: US 11,319,786 B2
(45) Date of Patent: May 3, 2022

(54) CONTROLLED ESP DISCHARGE SYSTEM PREVENTING GAS LOCK

(71) Applicant: Halliburton Energy Services, Inc., Houston, TX (US)

(72) Inventors: Donn J. Brown, Broken Arrow, OK (US); Ketankumar Kantilal Sheth, Tulsa, OK (US); Trevor Alan Kopecky, Owasso, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 215 days.

(21) Appl. No.: 16/778,455

(22) Filed: Jan. 31, 2020

(65) Prior Publication Data

US 2021/0238968 A1 Aug. 5, 2021

(51) Int. Cl.

| | |
|---|---|
| ***E21B 43/32*** | (2006.01) |
| ***E21B 43/12*** | (2006.01) |
| ***F04B 53/16*** | (2006.01) |
| ***F04B 17/03*** | (2006.01) |
| ***F04B 53/10*** | (2006.01) |
| ***F04C 13/00*** | (2006.01) |

(52) U.S. Cl.

CPC ..... *E21B 43/128* (2013.01); *E21B 43/126* (2013.01); *E21B 43/32* (2013.01); *F04B 17/03* (2013.01); *F04B 53/10* (2013.01); *F04B 53/16* (2013.01); *F04C 13/008* (2013.01)

(58) Field of Classification Search

CPC ..... E21B 43/32

See application file for complete search history.

(56) References Cited

U.S. PATENT DOCUMENTS

| | | | | |
|---|---|---|---|---|
| 9,181,785 | B2 * | 11/2015 | Lawson | E21B 43/128 |
| 10,677,032 | B1 * | 6/2020 | Norton | E21B 47/008 |
| 10,947,813 | B2 * | 3/2021 | Ejim | E21B 34/10 |
| 2009/0272538 | A1 | 11/2009 | Kennedy | |
| 2010/0108307 | A1 | 5/2010 | Brown et al. | |
| 2016/0194928 | A1 | 7/2016 | Delmar et al. | |
| 2016/0369788 | A1 | 12/2016 | Brown et al. | |

FOREIGN PATENT DOCUMENTS

| | | | |
|---|---|---|---|
| CN | 202788749 | U | 3/2013 |
| WO | 2013/155257 | A2 | 10/2013 |

OTHER PUBLICATIONS

International Search Report and Written Opinion issued in related PCT Application No. PCT/US2020/016550 dated Oct. 20, 2020, 12 pages.

* cited by examiner

*Primary Examiner* — Cathleen R Hutchins
(74) *Attorney, Agent, or Firm* — Conley Rose, P.C.; Rodney B. Carroll

(57) ABSTRACT

The disclosure provides a pressure escape system comprising: an intake port, wherein the intake port receives a downhole fluid; a sliding sleeve, wherein the sliding sleeve comprises fluid ports disposed through a portion of the sliding sleeve that is within a fluid flow path of the downhole fluid travelling from the intake port; a spring, wherein the spring is disposed within a housing and coupled to the sliding sleeve; and one or more exit ports, wherein the one or more exit ports are disposed through the housing and through the sliding sleeve.

18 Claims, 5 Drawing Sheets

CONTROLLED ESP DISCHARGE SYSTEM PREVENTING GAS LOCK

TECHNICAL FIELD OF THE INVENTION

The present disclosure relates generally to well drilling and hydrocarbon recovery operations and, more particularly, to systems and methods for pressure escape systems of a submersible pump.

BACKGROUND

Hydrocarbons, such as oil and gas, are produced or obtained from subterranean reservoir formations that may be located onshore or offshore. The development of subterranean operations and the processes involved in removing hydrocarbons from a subterranean formation typically involve several different steps, for example, drilling a wellbore at a desired well site, treating the wellbore to optimize production of hydrocarbons, performing the necessary steps to produce the hydrocarbons from the subterranean formation, and pumping the hydrocarbons to the surface of the earth.

When performing subterranean operations, pump systems, for example, electrical submersible pump (ESP) systems, may be used when reservoir pressure alone is insufficient to produce hydrocarbons from a well. For example, ESPs may be installed in a lower portion of the wellbore and used to pressurize fluids. ESPs may be used as an artificial lift method in downhole oil wells by creating the necessary lift or pressure to send fluids from the depths of the wellbore toward the surface. ESPs are very effective fluid moving devices and can be sized for different volumes of fluid and different required pressures or head necessary to pump the fluids to the surface. In order to handle higher pressure, ESP pumps are built in multiple stage configuration based on the pressure required. The range of number of pump stages can be in a range of a few to several hundreds of stages. The ESP pump stages are designed to move fluid as the fluid is almost completely non-compressible, however, in many production zones, gas is present and is pulled into an ESP with the fluid through the intake ports.

Generally, a submersible pump does not operate or function efficiently when exposed to gas. A pump can handle small quantities of gas (typically less than ten percent), but even small quantities of gas causes the pump to suffer some degradation of hydraulic performance. Economic and efficient pump operation may be affected by gas-laden fluid. The presence of gas in a pump causes a reduction in pressure created within the pump stages, reducing output of the pump. Large quantities of gas can create total stoppage of fluid flow due to the high pressure in the upper end of the pump and the column of liquid in the production tubing above the pump. The gas builds up in the individual stage vanes in the lower part of the pump and blocks the flow of the fluid, and therefore the stages cannot hydraulically move the fluid. This phenomenon is referred to as a "gas lock" condition, where gas is so prominent within the stages of the pump, the intended production fluid cannot be pumped to the surface.

When a gas lock condition is encountered, different tactics may be employed: for example, speeding up the speed (RPMs) of the pump to force out the gas, slowing down the speed of the pump in an effort to allow the bubbles of gas to coalesce out of the stages, or stopping the pump altogether which, because of the column of fluid above the pump, the fluid flows backward through the pump which reverses rotation of the pump. Reversal of rotation of the pump flushes or allows the gas to coalesce out of the pump until the fluid reaches an equilibrium in the casing. Other various methods that utilize separation systems have been designed that separate the gas from the liquid before the gas reaches the pump or stages are created to reduce the gas lock condition. As pumping must be stopped or delayed when using these methods, costs associated with an operation are increased including completion time for the overall operation and profits as well as a reduction in production of the fluid.

Figure 1:
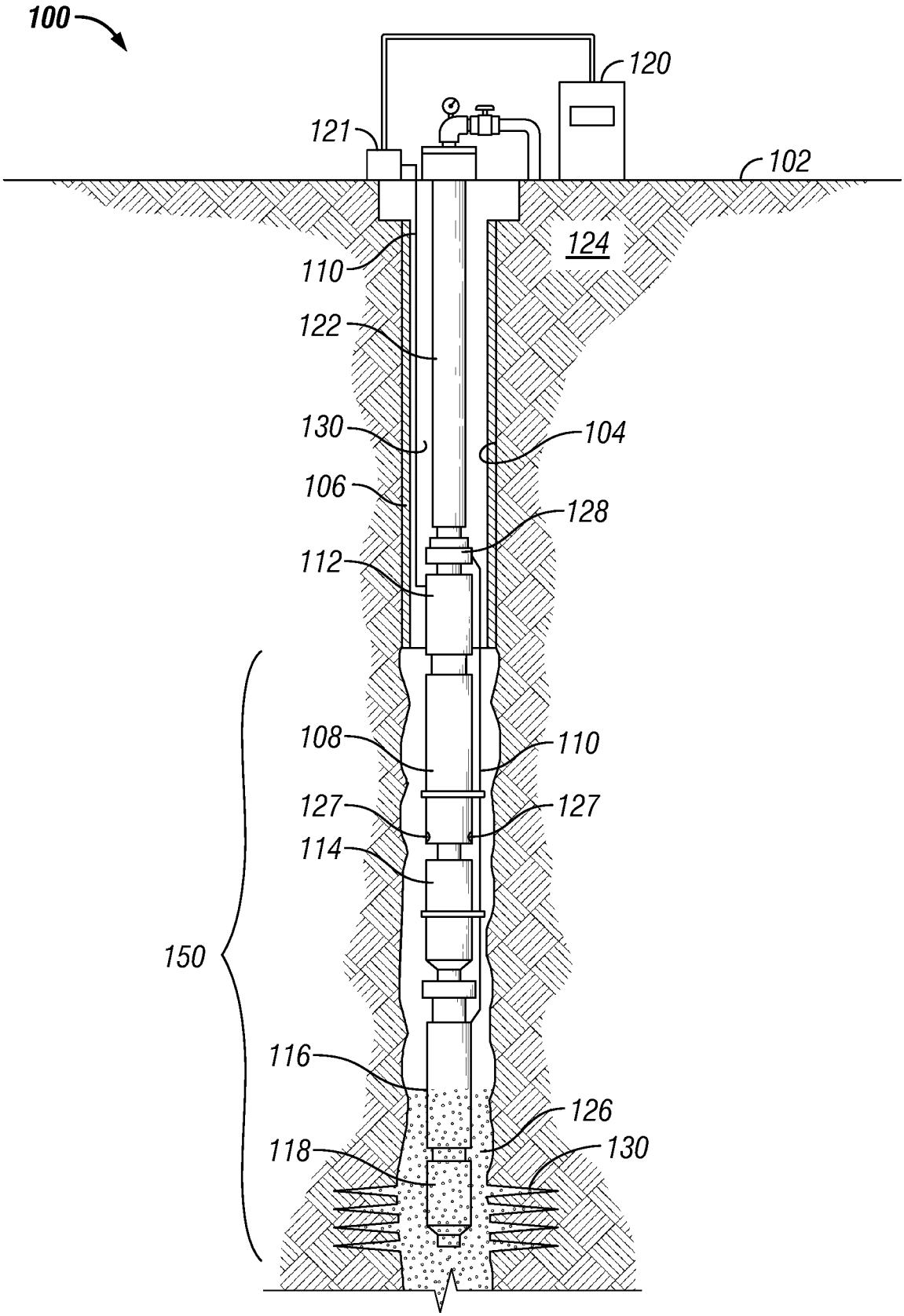
FIG. 1 is an illustrative well environment, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

A pressure escape system using one or more valves, a sliding sleeve, or combinations thereof which operates based on the discharge pressure or head pressure of a pump is desired. In one or more embodiments, a valve operating naturally may mean that the valve transitions to one or more positions on the basis of pressure changes, without any additional internal or external mechanisms or forces. One or more valves may be located in the head or top of a pump based on the output pressure of the pump stages below the head of the pump. When the pump experiences a gas lock condition, an upper valve may close which prevents the fluid in the production tubing above the pump system from draining back into the pump. The pressure from the column of fluid in the production tubing is held constant while a lower valve may drop or closes because of a drop in the output or discharge pressure of the pump. When the lower valve drops or closes the fluid flow of incoming fluid, the lower valve may open a pathway to an exit port. This exit port allows gas to escape, relieves the pressure within the pump and opens a pathway from the pump discharge to the annular pressure around the pump. This drop in pressure within the pump allows the gas to decompress and exit the pump by venting back into the annulus of the casing. When the gas has exited the pump and the pump builds up pressure inside the pump, the lower valve is disposed upwards and closed and seals off the exit port path. Subsequently, the sealing of the exit port increases the pressure inside the pump and the upper valve is opened and continues to produce as designed. Alternatively, a similar outcome can result with using a controller to actuate a sliding sleeve to opened and closed positions.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

The terms "couple" or "couples," as used herein are intended to mean either an indirect or direct connection. Thus, if a first device couples to a second device, that connection may be through a direct connection, or through an indirect electrical connection or a shaft coupling via other devices and connections.

FIG. 1 illustrates a well site environment 100, according to one or more aspects of the present invention. While well site environment 100 illustrates a land-based subterranean environment, the present disclosure contemplates any well site environment including a subsea environment. In one or more embodiments, any one or more components or elements may be used with subterranean operations equipment located on offshore platforms, drill ships, semi-submersibles, drilling barges and land-based rigs.

In one or more embodiments, well site environment 100 comprises a wellbore 104 below a surface 102 in a formation 124. In one or more embodiments, a wellbore 104 may comprise a nonconventional, horizontal or any other type of wellbore. Wellbore 104 may be defined in part by a casing string 106 that may extend from a surface 102 to a selected downhole location. Portions of wellbore 104 that do not comprise the casing string 106 may be referred to as open hole.

In one or more embodiments, various types of hydrocarbons or fluids may be pumped from wellbore 104 to the surface 102 using a pump system 150 disposed or positioned downhole, for example, within, partially within, or outside casing 106 of wellbore 104. In one or more embodiments, pump system 150 may comprise an electrical submersible pump (ESP) system. Pump system 150 may comprise a pump 108, an electrical cable 110, a pressure escape system 112, a seal or equalizer 114, a motor 116, and a sensor 118. The pump 108 may be an ESP, including but not limited to, a multi-stage centrifugal pump, a rod pump, a progressive cavity pump, any other suitable pump system or combination thereof. The pump 108 may transfer pressure to the fluid 126 or any other type of downhole fluid to propel the fluid from downhole to the surface 102 at a desired or selected pumping rate. In one or more embodiments, pump 108 may be coupled to a pressure escape system 112. Motor 116 may be coupled to a downhole sensor 118. In one or more embodiments, the electrical cable 110 is coupled to the motor 116 and to controller 120 at the surface 102. The electrical cable 110 may provide power to the motor 116, transmit one or more control or operation instructions from controller 120 to the motor 116, or both. As illustrated, the electrical cable 110 may be communicatively coupled to a flowmeter 121 disposed at the surface 102. Without limitations, the flowmeter 121 may be replaced with any suitable sensor utilized to measure a parameter of the fluid 126.

In one or more embodiments, fluid 126 may be a multiphase wellbore fluid comprising one or more hydrocarbons. For example, fluid 126 may be a two-phase fluid that comprises a gas phase and a liquid phase from a wellbore or reservoir in the formation 124. In one or more embodiments, fluid 126 may enter the wellbore 104, casing 106 or both through one or more perforations 130 in the formation 124 and flow uphole to one or more intake ports 127 of the pump system 150, wherein the one or more intake ports 127 are disposed at a distal end of the pump 108. The pump 108 may transfer pressure to the fluid 126 by adding kinetic energy to the fluid 126 via centrifugal force and converting the kinetic energy to potential energy in the form of pressure. In one or more embodiments, pump 108 lifts fluid 126 to the surface 102.

In one or more embodiments, motor 116 is an electrical submersible motor configured or operated to turn pump 108 and may, for example, be a two or more-pole, three-phase squirrel cage induction motor or a permanent magnet ESP style motor. In one or more embodiments, a production tubing section 122 may couple to the pump 108 using one or more connectors 128 or may couple directly to the pump 108. In one or more embodiments, any one or more production tubing sections 122 may be coupled together to extend the pump system 150 into the wellbore 104 to a desired or specified location. Any one or more components of fluid 126 may be pumped from pump 108 through production tubing 122 to the surface 102 for transfer to a storage tank, a pipeline, transportation vehicle, any other storage, distribution or transportation system and any combination thereof. During operations, gas present with the fluid 126 may be forced out of the pump 108 via the pressure escape system 112 into an annulus 130 of the wellbore 104.

Figure 2:
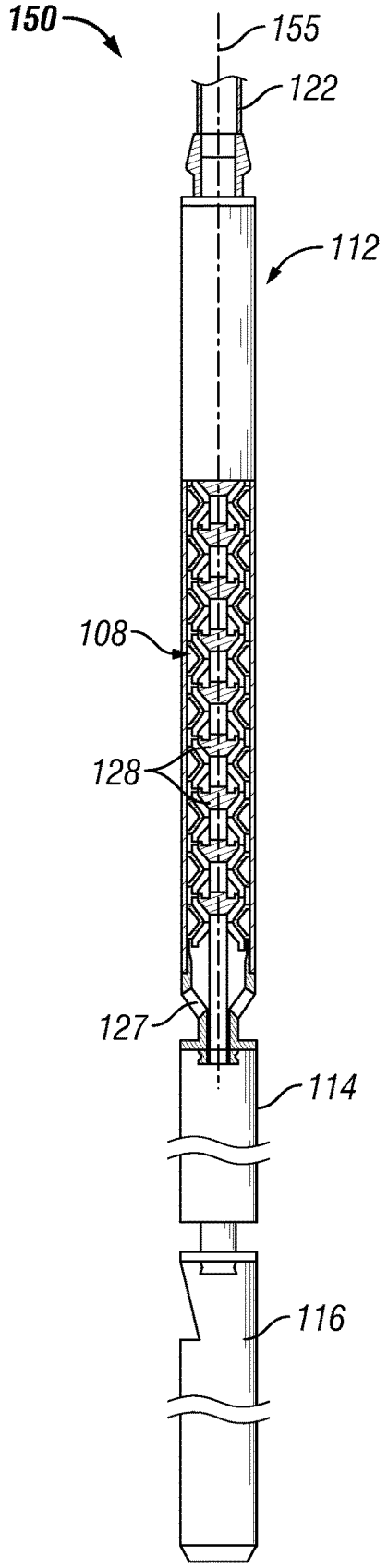
FIG. 2 is an illustrative pump system, according to one or more aspects of the present disclosure.

FIG. 2 is an illustrative pump system 150, according to one or more aspects of the present disclosure. A shaft 155 may run through one or more components or elements of pump system 150 so as to couple the one or more components to one or more other components. The shaft 155 may transmit or communicate rotation of motor 116 to one or more components or elements of pressure escape system 112. Fluid 126 (referring to FIG. 1) may be pushed or forced into the one or more intake ports 127 by a fluid pressure in the wellbore 104. In embodiments, the pump 108 may comprise one or more pump stages 128. Each pump stage 128 may comprise an impeller for increasing the pressure of the fluid as the fluid moves up each pump stage. The pump system 150 may further comprise the pressure escape system 112 positioned at the head of pump 108 such that fluid is pressurized and supplied to the pressure escape system 112 by the pump 108.

Figure 3A:
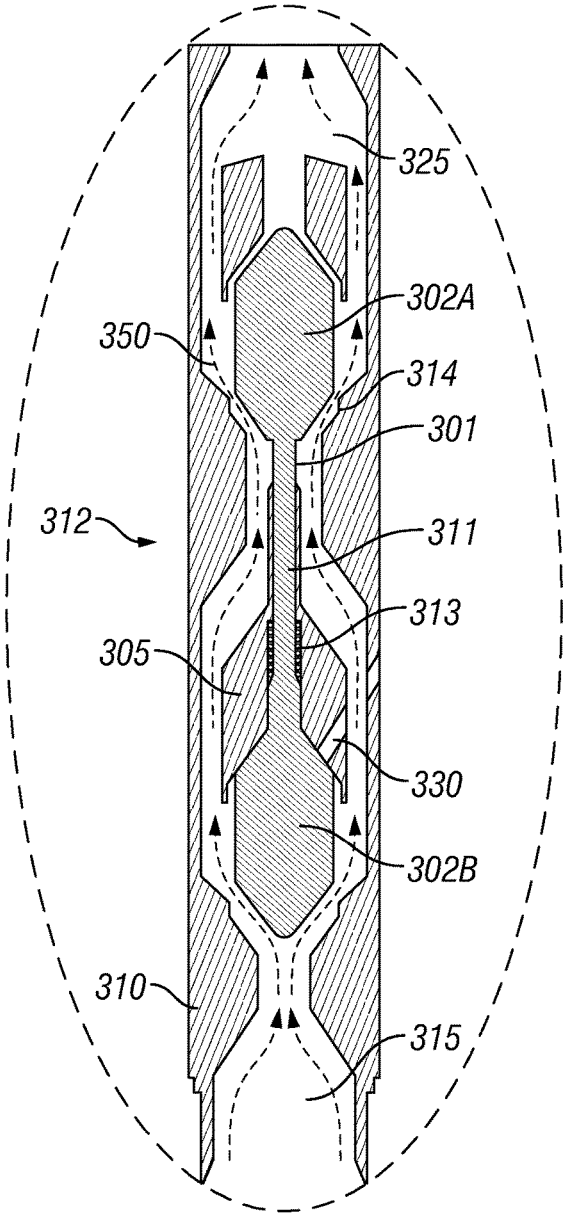
FIG. 3A is a partial cross-sectional view of an illustrative pressure escape system of a pump system in a normal operation state, according to one or more aspects of the present disclosure.

FIG. 3A is a partial cross-sectional view of an illustrative pressure escape system 312 of the pump system 150 (referring to FIG. 1) in a normal operation state, according to one or more aspects of the present disclosure. The pressure escape system 312 may be similar to or the same as pressure escape system 112 of FIG. 1. In one or more embodiments, the upper and lower valve may be a unitary, dual valve 301 as shown in FIG. 3A. For example, dual valve 301 may be a rod valve and comprise an upper end 302A, a lower end 302B, and a rod 311. Dual valve 301 may further comprise an enclosed spring 313 to force the dual valve 301 to an open state or a closed state during non-operation, for example, during installation of the pump system 150.

Dual valve 301 may be in an open state under normal pumping operations. The open state of the dual valve 301 may correspond to an "up" position of the upper end 302A and lower end 302B, respectively. In the "up" position, fluid, for example, fluid 126 of FIG. 1, may flow freely from an intake port 315, and out a discharge port 325, as indicated by fluid flow lines 350. The "closed" state of the dual valve 301 may correspond to upper end 302A and lower end 302B in a "down" position. In a down position, the upper end 302A may be positioned or may sit against a seat 314 to form a seal such that fluid cannot pass through the upper end 302A. Seat 314 may be configured such that seat 314 allows upper end 302A to be positioned or to sit against seat 314 under normal forces of gravity, for example, when the pump 108 is static or not operating. When lower end 302B is positioned in a down position, the lower end 302B may be in a "floating" position, such that it is suspended above and below nearby structures. In embodiments, fluid 126 may be able to pass through lower end 302B and gas may be able to exit into the annulus 130 (referring to FIG. 1). In the closed state, the upper end 302A may block or obstruct fluid 126 from flowing back from the production tubing 122 into the pump 108 and from the pump 108 through the pressure escape system 312 and out the discharge port 325.

As shown in FIG. 3A, under normal pumping operations, dual valve 301 may be positioned or disposed such that lower end 302B and upper end 302A are in the up position, whereby dual valve 301 allows the passage of fluid, for example, fluid 126 of FIG. 1, through the pressure escape system 312 and out the discharge port 325. Upper end 302A and lower end 302B may be shaped such that upper end 302A and lower end 302B fit with an inner diameter 305 of the pressure escape system 312 to form a seal. For example, as shown in FIG. 3A, upper end 302A and lower end 302B of valve 301 may be octagonically shaped. As one of ordinary skill in the art would understand, upper end 302A, lower end 302B, or both may be shaped with any number of edges so as to form a seal against the inner diameter 305 or outer diameter 310 of the pressure escape system 312. During normal operation of the pump, for example, pump 108 of FIG. 1, lower end 302B may be positioned against inner diameter 305 such that fluid 126 may pass from an intake port 315 up through the pressure escape system 312. Furthermore, lower end 302B may form a seal against an exit port 330 so that no fluid 126 may flow through exit port 330.

Figure 3B:
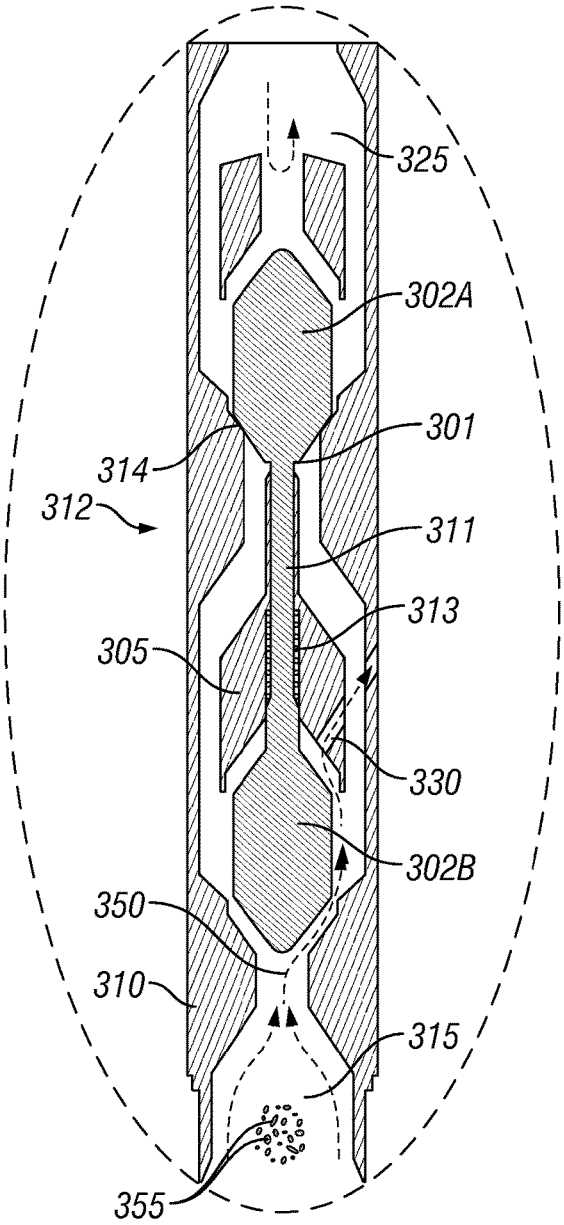
FIG. 3B is a partial cross-sectional view of an illustrative pressure escape system of a pump system is a gas lock condition state, according to one or more aspects of the present disclosure.

FIG. 3B is a partial cross-sectional view of an illustrative pressure escape system 312 of the pump system 150 (referring to FIG. 1) in a gas-lock state, according to one or more aspects of the present disclosure. As a gas 355 is introduced into the one or more pump stages 128 (referring to FIG. 2) below the pressure escape system 312, fluid pressure of fluid 126 from the one or more pump stages 128 is decreased. The higher pressure fluid 126 at the discharge port 325 of the pressure escape system 312 forces upper end 302A into the down position where upper end 302A contacts and forms a seal with the outer diameter 310 by being displaced into seat 314. Thus, upper end 302A blocks fluid 126 from flowing through the pressure escape system 312 and out discharge port 325 and/or from the production tubing 122 (referring to FIG. 1) into the pump 108 (referring to FIG. 1). Higher pressure fluid 126 from the production tubing 122 above is thus prevented from draining back into the pump 108. The drop in pressure from the discharge port 325 of the pump 108 causes the lower end 302B to drop to the floating position, where the lower end 302B is neither in an up position or a down position, and the exit port 330 is exposed. In this floating position, the pump 108 may continue to pump which allows gas 355 to decompress and be released through exit port 330 and into the annulus 130 (referring to FIG. 1) of the casing 106 (referring to FIG. 1). The lower end 302B moving to the floating position may be facilitated by spring 313. The amount of gas required to be released may depend on a number of factors. For example, any one or more of the types of pump stage 128, the number of pump stages 128, and the depth of the pumping system 150 may affect the amount of gas that must be vented before returning to normal pumping operations. In one or more embodiments, a pump may be able to handle 15% gas before a gas-lock condition occurs. In one or more embodiments, gas in the pump may be decreased to 5% gas before normal pumping operations may resume. However, one of ordinary skill in the art would understand that the amount of gas triggering a gas-lock condition and for returning to normal pumping operations may vary, for example, based on one or more of the factors listed above.

Once a sufficient amount of gas 355 has been released and the pump 108 regains its discharge pressure, the one or more pump stages 128 may resume pumping fluid 126 through intake port 315 to force lower end 302B to the up position, sealing off exit port 330 and allowing fluid 126 to flow upwards toward the surface 102. In embodiments, the lower end 302B displaces in tangent with the upper end 302A. The increased fluid pressure of fluid 126 will likewise force upper end 302A to the up position, allowing fluid 126 to flow through discharge port 325. Thus, the embodiments discussed herein naturally minimize gas build-up or gas lock without having to alter operation of the pump 108.

Figure 4A:
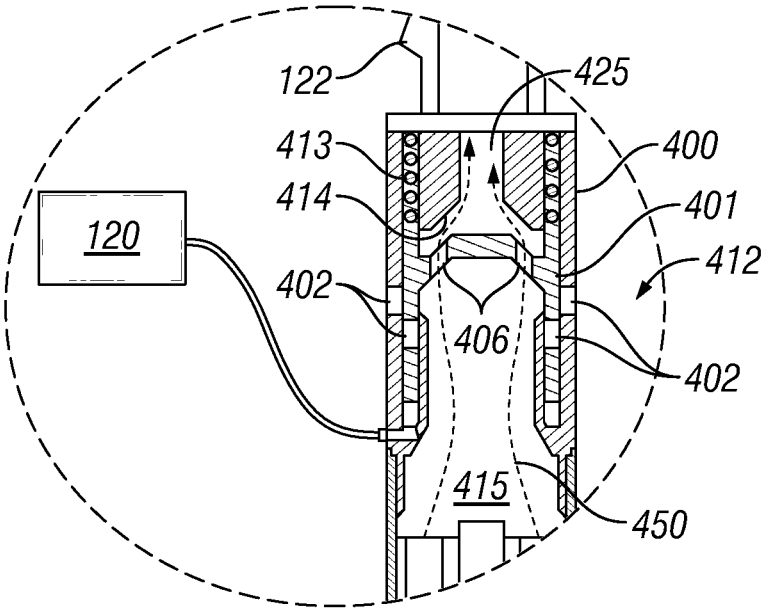
FIG. 4A is a partial cross-sectional view of an illustrative pressure escape system of a pump system in a normal operation state, according to one or more aspects of the present disclosure.

FIG. 4A is a partial cross-sectional view of an illustrative pressure escape system 412 of a pump system 150 (referring to FIG. 1) in a normal operation state, according to one or more aspects of the present disclosure. The pressure escape system 412 may be similar to or the same as pressure escape system 112 of FIG. 1. In one or more embodiments, the pressure escape system 412 may comprise a housing 400, a sliding sleeve 401, and one or more exit ports 402. The pressure escape system 412 may further comprise an enclosed spring 413 to force the sliding sleeve to an open state or a closed state during non-operation, for example, during installation of the pump system 150.

The pressure escape system 412 may be in an open state under normal pumping operations. The open state of the pressure escape system 412 may correspond to a non-compressed position of the spring 413. In the non-compressed position, fluid, for example, fluid 126 of FIG. 1, may flow freely from an intake port 415, and out a discharge port 425, as indicated by fluid flow lines 450. The closed state of the pressure escape system 412 may correspond to the spring 413 being in a compressed position. In the compressed position, the sliding sleeve 401 may be positioned or may sit against a seat 414 to form a seal such that fluid cannot pass through the sliding sleeve 401. Seat 414 may be configured such that seat 414 allows sliding sleeve 401 to be positioned or to sit against seat 414 under while the spring 413 is actuated to compress. In embodiments, gas may be able to exit into the annulus 130 (referring to FIG. 1) via the one or more exit ports 402 when the pressure escape system 412 is in the closed state. In one or more embodiments, both the sliding sleeve 401 and the housing 400 may comprise one or more exit ports 402. The one or more exit ports 402 of both the sliding sleeve 401 and the housing 400 must be aligned in order for there to be fluid communication from the interior of the pressure escape system 412 to the exterior. In the closed state, the sliding sleeve 401 may block or obstruct fluid 126 from flowing back from the production tubing 122 into the pump 108 and from the pump 108 through the pressure escape system 412 and out into the production tubing 122.

As shown in FIG. 4A, under normal pumping operations, the pressure escape system 412 may be positioned or disposed in the open state, whereby sliding sleeve 401 allows the passage of fluid, for example, fluid 126 of FIG. 1, through the pressure escape system 412 and out the discharge port 425. In one or more embodiments, there may be fluid ports 406 disposed through a portion of the sliding sleeve 401 that is within the fluid flow path of the fluid 126 incoming from the intake port 415. When the pressure escape system 412 is in the open state, the fluid ports 406 may be open to allow the fluid 126 to flow through the sliding sleeve and out the discharge port 425. In the open state, the one or more exit ports 402 of the sliding sleeve may not be aligned with the one or more exit ports 402 of the housing 400. In embodiments, the sliding sleeve 401 may be disposed within and may be configured to translate along the housing 400. Without limitations, the housing 400 may be any suitable size, height, shape, and any combinations thereof. As illustrated, the spring 413 may be disposed within a proximal end of the housing 400 and coupled to the sliding sleeve 401.

Figure 4B:
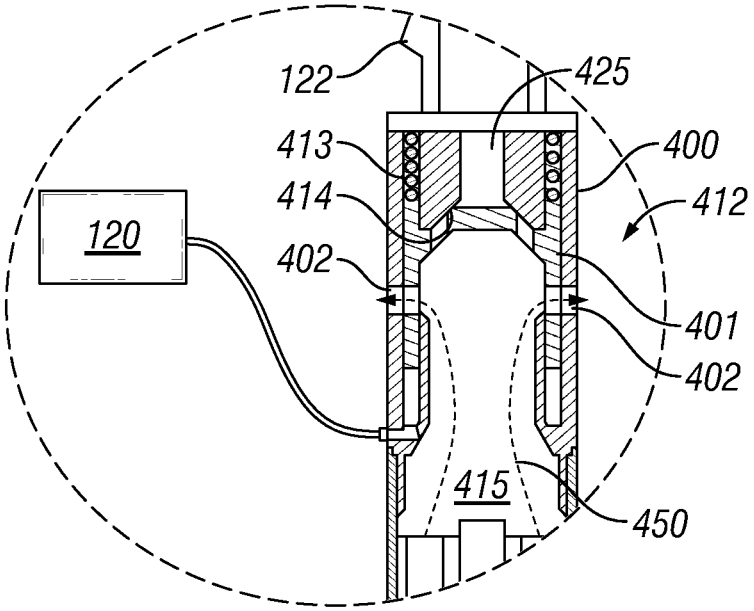
FIG. 4B is a partial cross-sectional view of an illustrative pressure escape system of a pump system in a gas lock condition state, according to one or more aspects of the present disclosure.

FIG. 4B is a partial cross-sectional view of an illustrative pressure escape system 412 of the pump system 150 in a gas-lock state, according to one or more aspects of the present disclosure. As the gas 355 (referring to FIG. 3B) is introduced into the one or more pump stages 128 (referring to FIG. 2) below the pressure escape system 412, fluid pressure of fluid 126 from the one or more pump stages 128 is decreased. In one or more embodiments, this decrease in pressure may be measured via the flowmeter 121 (referring to FIG. 1), by the loading of the motor 116, any other suitable method, and combinations thereof. The controller 120 may operate to compress the spring 413 so as to shift the pressure escape system 412 into a closed state. Without limitations, the controller 120 may be coupled to the housing 400 in any suitable manner. By compressing the spring 413, the sliding sleeve 401 may translate within the housing 400 so as to be seated against the seat 414. Once disposed against the seat 414, a seal may be created to prevent fluid 126 from flowing through the fluid ports 406. In the closed state, the one or more exit ports 402 of the sliding sleeve 401 may be aligned with the one or more exit ports 402 of the housing 402. In this position, the pump 108 may continue to pump which allows gas 355 to decompress and be released through the one or more exit ports 402 and into the annulus 130 (referring to FIG. 1) of the casing 106 (referring to FIG. 1).

Once a sufficient amount of gas 355 has been released and the pump 108 regains its discharge pressure, the controller 120 may operate to actuate the spring 413 to expand from the compressed state. By doing so, the seal against the seat 414 is removed, and fluid 126 may flow upwards through the fluid ports 406 and toward the surface 102. Thus, the embodiments discussed herein minimize gas build-up or gas lock without having to alter operation of the pump 108.

Figure 5:
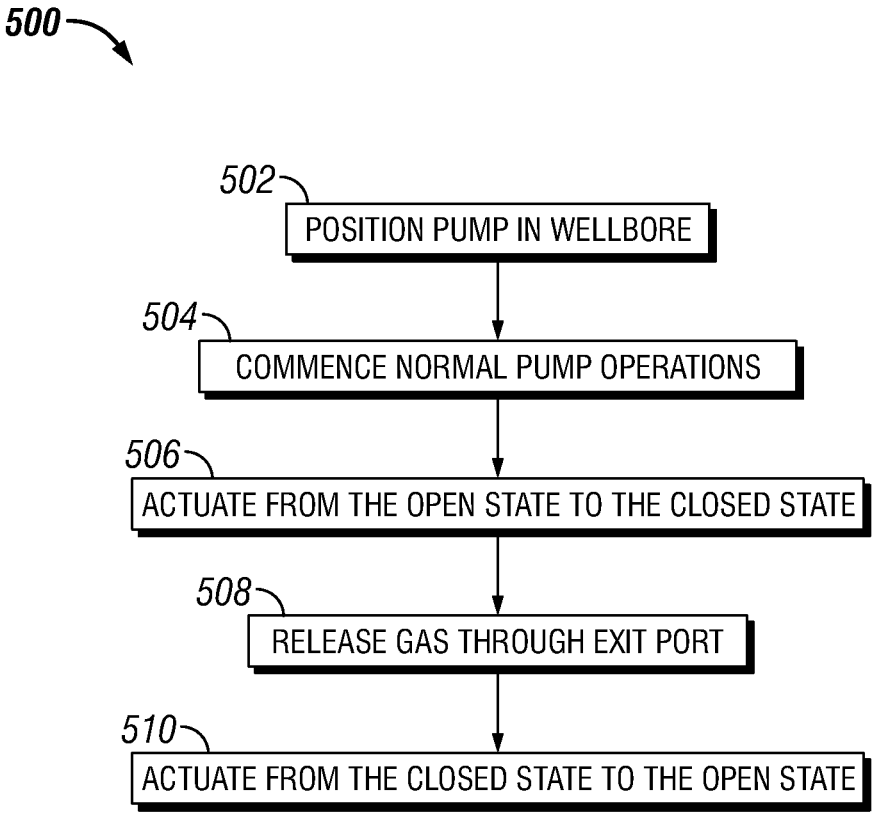
FIG. 5 is a flow chart illustrating a method of pressure escape for a pump (ESP) system, according to one or more aspects of the present disclosure.

FIG. 5 is a flow chart illustrating a method 500 for pressure escape of a pump system 150, according to one or more aspects of the present disclosure. At step 502, a pump system 150 is positioned or disposed in a wellbore 104 where the pump system 150 comprises a pressure escape system 112. In one or more embodiments, the pump system 150 may be part of or included with a downhole tool. The pump system 150 may be positioned or disposed such that one or more portions of the pump system 150 are submerged in or otherwise adjacent to a fluid 126 of FIG. 1.

At step 504, normal pumping operations are commenced. Fluid 126 is pushed or forced into the one or more intake ports 127 by a fluid pressure of pump 108 in the wellbore 104. Fluid 126 moves through the one or more pump stages 128 to the pressure escape system 112. The pressure escape system 112 allows fluid to flow freely to the discharge port 325 or 425 as pressure escape system 112 is in the open state.

At step 506, the pressure escape system 112 may be actuated from the open state to the closed state. If the pressure escape system 112 comprises the dual valve 301, the upper end 302A may transition or drops to the down position due to the presence of gas 355 which decreases the amount of fluid 126 being pumped by pump 108. In one or more embodiments, the presence of gas 355 may indicate a gas-lock condition or a precursor to a gas-lock condition. The pressure from the production tubing 122 forces the upper end 302A to down position. The lower end 302B transitions or drops to the down position due to the decrease in pressure from the production tubing 122. The down position of the lower end 302B forms a seal which prevents fluid 126 from flowing through the dual valve 301 and exposes the exit port 330 in the outer diameter of the pumping system 150.

If the pressure escape system 112 comprises the sliding sleeve 401, the controller 120 may operate to actuate the spring 413 to compress to the closed state. In the closed state, the one or more exit ports 402 of the sliding sleeve 401 may be aligned with the one or more exit ports 402 of the housing, thereby allowing fluid communication for the gas 355 and/or fluid 126 while preventing the fluid 126 present above in the production tubing 122 from flowing back down into the pump 108.

At step 508, gas 355 is released through the exit port 330 of the dual valve 301 or through the one or more exit ports 402 in the embodiment of the sliding sleeve 401, preventing or minimizing a gas-lock condition, the presence of gas 355 in the pumping system 150, or both. The upper end 302A and lower end 302B of dual valve 301 and/or the sliding sleeve 401 may stay in the closed position until a sufficient amount of gas 355 has been released.

At step 510, the pressure escape system 112 may be actuated from the closed state to the open state. The lower end 302A transitions or returns to an open position based on the fluid pressure increasing from the one or more pump stages 128. The fluid pressure of fluid 126 increases due to the reduction of gas in the pump stages 128. The upper end 302A transitions or returns to an open position based on fluid pressure increasing from the one or more pump stages 128. Thus, the pump 108 is returned its previous state of normal pumping operations based on natural pressure increases and decreases in the pump system 150 and production tubing 122. With utilizing the sliding sleeve 401, the controller 120 may be configured to actuate the spring to expand from its compressed position in order to return the pressure escape system 112 to the open position. As the spring 413 expands, the fluid ports 406 may become accessible for the fluid 126 to flow through and out to the discharge port 425.

According to one or more aspects of the present disclosure, the pump system 150 provides an efficient and cost-effective pressure escape system 112 of a fluid 126 in a wellbore 104. By reducing or eliminating the gas-lock condition during pumping operations, improved pump performance with minimal interruption or decreasing productivity and time for completion of an operation, for example, a hydrocarbon recovery and production operation.

An embodiment of the present disclosure is a pressure escape system, comprising: an intake port, wherein the intake port receives a downhole fluid; a sliding sleeve, wherein the sliding sleeve comprises fluid ports disposed through a portion of the sliding sleeve that is within a fluid flow path of the downhole fluid travelling from the intake port; a spring, wherein the spring is disposed within a housing and coupled to the sliding sleeve; and one or more exit ports, wherein the one or more exit ports are disposed through the housing and through the sliding sleeve.

In one or more embodiments described in the preceding paragraph, wherein the pressure escape system is positioned uphole from a pump. In one or more embodiments described above, wherein the pressure escape system is coupled to a production tubing. In one or more embodiments described above, wherein in a first position, the spring is expanded and the sliding sleeve is positioned such that fluid may flow from the intake port to a discharge port. In one or more embodiments described above, wherein in a second position, the spring is compressed and the sliding sleeve is positioned such that fluid is blocked from flowing from the intake port to a discharge port through the fluid ports. In one or more embodiments described above, wherein in the second position, the one or more exit ports of the housing are aligned with the one or more exit ports of the sliding sleeve. In one or more embodiments described above, further comprising a seat, wherein the sliding sleeve is configured to seal against the seat. In one or more embodiments described above, further comprising a controller configured to actuate the spring.

Another embodiment of the present disclosure is a method comprising: positioning a pump in a wellbore; commencing pumping operations; transitioning a pressure escape system from an open state to a closed state; releasing gas through one or more exit ports; and transitioning the pressure escape system from the closed state to the open state.

In one or more embodiments described in the preceding paragraph, wherein transitioning the pressure escape system from the open state to the closed state comprises of actuating a spring to compress within a housing. In one or more embodiments described above, wherein a controller is configured to actuate the spring to compress within the housing. In one or more embodiments described above, wherein actuating the spring to compress within a housing comprises of translating a sliding sleeve to seat against a seat. In one or more embodiments described above, wherein releasing gas through one or more exit ports results in a reduction or elimination of a gas-lock condition. In one or more embodiments described above, wherein transitioning the pressure escape system from the closed state to the open state comprises of actuating a spring to expand within a housing. In one or more embodiments described above, wherein a controller is configured to actuate the spring to expand within the housing. In one or more embodiments described above, wherein actuating the spring to expand within the housing comprises of translating a sliding sleeve away from a seat configured to receive the sliding sleeve.

Another embodiment of the present disclosure is a pump system, comprising: a pump; an electrical cable; a pressure escape system, wherein the pressure escape system comprises: an intake port, wherein the intake port receives a downhole fluid; a sliding sleeve, wherein the sliding sleeve comprises fluid ports disposed through a portion of the sliding sleeve that is within a fluid flow path of the downhole fluid travelling from the intake port; a spring, wherein the spring is disposed within a housing and coupled to the sliding sleeve; and one or more exit ports, wherein the one or more exit ports are disposed through the housing and through the sliding sleeve; a seal; a motor; and a sensor; wherein the motor is coupled to the sensor, wherein the seal is disposed between the motor and the pump, wherein the pressure escape system is coupled to the pump, wherein the electrical cable is communicatively coupled to the motor.

In one or more embodiments described in the preceding paragraph, further comprising a controller configured to actuate the spring. In one or more embodiments described above, wherein the pressure escape system further comprises a seat, wherein the sliding sleeve is configured to seal against the seat. In one or more embodiments described above, wherein the pressure escape system is coupled to a production tubing.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A pressure escape system, comprising:

an intake port, wherein the intake port receives a downhole fluid;

a sliding sleeve, wherein the sliding sleeve comprises fluid ports disposed through a portion of the sliding sleeve that is within a fluid flow path of the downhole fluid travelling from the intake port;

a spring, wherein the spring is disposed within a housing and coupled to the sliding sleeve, wherein in a first position, the spring is expanded and the sliding sleeve is positioned such that fluid may flow from the intake port to a discharge port, wherein in a second position, the spring is compressed and the sliding sleeve is positioned such that fluid is blocked from flowing from the intake port to a discharge port through the fluid ports; and one or more exit ports, wherein the one or more exit ports are disposed through the housing and through the sliding sleeve.

2. The pressure escape system of claim 1, wherein the pressure escape system is positioned uphole from a pump.

3. The pressure escape system of claim 1, wherein the pressure escape system is coupled to a production tubing.

4. The pressure escape system of claim 1, wherein in the second position, the one or more exit ports of the housing are aligned with the one or more exit ports of the sliding sleeve.

5. The pressure escape system of claim 1, further comprising a seat, wherein the sliding sleeve is configured to seal against the seat.

6. The pressure escape system of claim 1, further comprising a controller configured to actuate the spring.

7. A method, comprising the steps of:

positioning a pump in a wellbore;

commencing pumping operations;

transitioning a pressure escape system from an open state to a closed state, wherein transitioning the pressure escape system from the open state to the closed state comprises of actuating a spring, via a controller, to compress within a housing;

releasing gas through one or more exit ports; and transitioning the pressure escape system from the closed state to the open state.

8. The method of claim 7, wherein actuating the spring to compress within a housing comprises of translating a sliding sleeve to seat against a seat.

9. The method of claim 7, wherein releasing gas through one or more exit ports results in a reduction or elimination of a gas-lock condition.

10. The method of claim 7, wherein transitioning the pressure escape system from the closed state to the open state comprises of actuating the spring to expand within a housing.

11. The method of claim 10, wherein the controller is configured to actuate the spring to expand within the housing.

12. The method of claim 10, wherein actuating the spring to expand within the housing comprises of translating a sliding sleeve away from a seat configured to receive the sliding sleeve.

13. The method of claim 7, wherein the pressure escape system is positioned uphole from the pump.

14. A pump system, comprising:

a pump;

an electrical cable;

a pressure escape system, wherein the pressure escape system comprises:

an intake port, wherein the intake port receives a downhole fluid;

a sliding sleeve, wherein the sliding sleeve comprises fluid ports disposed through a portion of the sliding sleeve that is within a fluid flow path of the downhole fluid travelling from the intake port;

a spring, wherein the spring is disposed within a housing and coupled to the sliding sleeve, wherein in a first position, the spring is expanded and the sliding sleeve is positioned such that fluid may flow from the intake port to a discharge port, wherein in a second position, the spring is compressed and the sliding sleeve is positioned such that fluid is blocked from flowing from the intake port to a discharge port through the fluid ports; and one or more exit ports, wherein the one or more exit ports are disposed through the housing and through the sliding sleeve;

a seal;

a motor; and a sensor;

wherein the motor is coupled to the sensor, wherein the seal is disposed between the motor and the pump, wherein the pressure escape system is coupled to the pump, wherein the electrical cable is communicatively coupled to the motor.

15. The pump system of claim 14, further comprising a controller configured to actuate the spring.

16. The pump system of claim 14, wherein the pressure escape system further comprises a seat, wherein the sliding sleeve is configured to seal against the seat.

17. The pump system of claim 14, wherein the pressure escape system is coupled to a production tubing.

18. The pump system of claim 14, wherein in the second position, the one or more exit ports of the housing are aligned with the one or more exit ports of the sliding sleeve.

* * * * *